US007695326B1

(12) United States Patent
Freitag

(10) Patent No.: US 7,695,326 B1
(45) Date of Patent: Apr. 13, 2010

(54) LEVER LOCK BATTERY TERMINAL

(75) Inventor: Erik Freitag, Arlington Heights, IL (US)

(73) Assignee: Royal Die & Stamping, Bensenville, IL (US)

( * ) Notice: Subject to any disclaimer, the term of this patent is extended or adjusted under 35 U.S.C. 154(b) by 0 days.

(21) Appl. No.: 12/313,430

(22) Filed: Nov. 20, 2008

(51) Int. Cl.
*H01R 4/50* (2006.01)

(52) U.S. Cl. ..... 439/772

(58) Field of Classification Search ..... 439/772, 439/773, 522, 863–864, 756
See application file for complete search history.

(56) References Cited

U.S. PATENT DOCUMENTS 2,706,284 A * 4/1955 Hoggatt et al. ..... 439/757
3,568,139 A * 3/1971 Delzer ..... 439/759
4,555,159 A * 11/1985 Chartrain et al. ..... 439/773
5,269,709 A * 12/1993 Eriksson ..... 439/772
5,389,466 A * 2/1995 Inoue et al. ..... 429/178
5,645,448 A * 7/1997 Hill ..... 439/522
6,174,207 B1 * 1/2001 Cleveland ..... 439/773
6,398,595 B2 * 6/2002 Wakata et al. ..... 439/755
6,413,124 B2 * 7/2002 Murakami et al. ..... 439/773
7,046,115 B2 * 5/2006 Higuchi et al. ..... 337/193
7,189,122 B2 * 3/2007 Freitag ..... 439/773
7,303,448 B1 * 12/2007 Sproesser ..... 439/773

* cited by examiner

*Primary Examiner*—Jean F Duverne
(74) *Attorney, Agent, or Firm*—McDermott Will & Emery LLP

(57) ABSTRACT

A battery terminal connector for a generally cube-shaped automotive battery. The battery has a flat, horizontally disposed top. The battery terminal connector has a body portion with a top, a bottom, and an intermediate aperture for engaging a battery post. This intermediate aperture has a size that is variable to accommodate placement of the connector onto, and the removal of the connector from, the battery post. The battery terminal connector has a lever with two opposite ends, the first end being connected to the terminal connector, and the second end being positioned above the flat horizontally disposed top of the battery. The second end is easily accessible so as to permit a user to actuate that lever, and move that lever from a first position to a second position. Movement from the first to the second position facilitates the removal of overcaps.

7 Claims, 4 Drawing Sheets

LEVER LOCK BATTERY TERMINAL

CROSS-REFERENCE TO RELATED APPLICATIONS

None.

FEDERALLY SPONSORED RESEARCH OR DEVELOPMENT

Not Applicable.

TECHNICAL FIELD

This invention is directed to a battery terminal comprising a lever for releasing the terminal from the battery post of a typical automotive battery. The construction of the lever facilitates easier removal of the battery terminal from the battery post. The construction of the lever further facilitates removal of a battery terminal cap.

BACKGROUND OF THE INVENTION

Storage batteries of the type used in automobiles, trucks and the like generally have a terminal post made of a lead alloy material with a cylindrical or frusto-conical shape. The battery is connected to the vehicle electrical system by a battery cable assembly. The cable assembly has connectors which clamp to the battery posts, providing a secure electrical and mechanical connection.

A conventional connector for connecting cables to the battery is a molded, generally U-shaped device with a bolt passing through outwardly projecting yoke-like arms for securely clamping the connector to the battery post. The connector may also be a stamped metal battery terminal connector, fabricated from sheet metal.

U.S. Pat. No. 5,733,152 ("the '152 patent") is directed to a typical battery terminal connector. The '152 patent is owned by the assignee of the present application, and relates to a battery terminal connector which permits improved mechanical and electrical connection to a battery terminal post. The connector of the '152 patent has enhanced resistance to rotation when connected to a battery terminal post. That connector is also economical to manufacture, and can be made by automated assembly and production. An additional advantage of this connector is that it is adaptable to different automobile models and batteries.

U.S. Pat. No. 5,879,202 ("the '202 patent") is also directed to another battery terminal connector. This connector is of the type that permits it to be tightened on the battery post using a threaded nut that is positioned above, rather than on the side of, the connector. As a result, especially in tight, confining areas found under the hoods of modern automobiles, the nut is more easily accessed during installation of the connector of the '202 patent, as compared to the ease of access to threaded nuts that are secured to the sides of many prior art connectors.

An additional battery terminal connector is that manufactured by the Chang Hwan Company of South Korea (http://www.cpt.co.kr). This connector includes two upturned flanges that together define the aperture for the battery post. Because of its multi-piece structure, this Chang Hwan connector requires an additional labor step when the wiring harness is attached to the automobile, during its manufacture. In addition, the junction between the two pieces is a site where corrosion or failure can occur. This junction thus raises the risk of a mechanical or electrical problem, resulting in inconvenience for the consumer, and increasing the potential for warranty costs or public relations problems for the manufacturer. Moreover, this Chang Hwan connector has a threaded rod and nut at its first lateral end, i.e., the end of the connector farthest from the ferrule portion. This structure increases the bulk at the frontal portion of the Chang Hwan connector. In addition, the approximate 5 millimeters distance between the two upturned flanges is roughly equal to the 5 millimeters height of each of those flanges. Accordingly, this connector has a generally high profile, and is thus somewhat less suitable for use in tight, under-hood areas.

Additional prior art references include U.S. Pat. Nos. 6,250,973, 5,941,738, 5,879,202, 5,800,219, 5,738,552, 5,711,688, 5,672,442, 5,599,210, 5,316,505, 4,354,726, 4,063,794, 4,054,355, and 3,568,138. None of these patents, however, alone or in combination, disclose the present invention.

SUMMARY OF THE INVENTION

The invention is a battery terminal connector for a generally cube-shaped automotive battery, the battery having a flat, horizontally disposed top. The battery terminal connector has a body portion. The body portion has a top; a bottom; and an intermediate aperture for engaging a battery post.

The intermediate aperture has a size that is variable to accommodate placement of the connector onto, and the removal of the connector from, the battery post. The battery terminal connector further has a lever with two opposite ends. The first end is connected to the terminal connector. The second end is positioned above the flat, horizontally disposed top of the battery. In this way, the second end is easily accessible, so as to permit a user to actuate that lever.

When that lever is moved from a first position to a second position, the lever opens an aperture that is engageable with a battery post of the battery.

The battery terminal connector also includes a ferrule portion, for connection with a battery cable.

The connection of the first end of the lever to the battery terminal connector is a pivotal connection In addition, the second end of the lever includes an insulating covering.

The connector further includes a locking block with generally wedge-shaped ramping surfaces. This locking block facilitates the fixed retention of the lever, when that lever is in its first position. The locking block further provides resistance to the movement of the lever, when that lever is being moved from its first position to the second position, and then back again from its second position to its first position.

In this invention, a portion of the lever is engagable with overcaps on the automotive battery. Such engagement facilitates removal of the overcaps, upon movement of the lever from its first position to its second position.

As indicated above, movement of the lever from its first position to its second position releases the grip of the battery terminal connector upon the battery post Movement of the lever from its second position to its first position facilitates a grip of the battery terminal connector upon the battery post In a preferred embodiment, the lever has a generally z-shaped profile.

DETAILED DESCRIPTION

There are many possible embodiments of this invention. The drawings and description below describe in detail a preferred embodiment of the invention. It should be understood that the present disclosure is to be considered as an example of the principles of the invention. The disclosure is not intended to limit the broad aspect of the invention to the embodiments illustrated.

Figure 7:
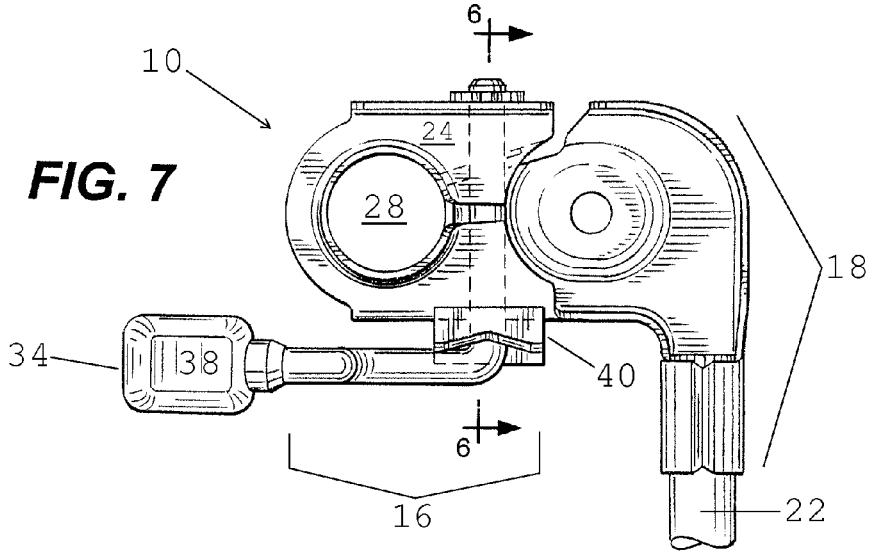
FIG. 7 is an overhead view of the connector of the invention.
Figure 8:
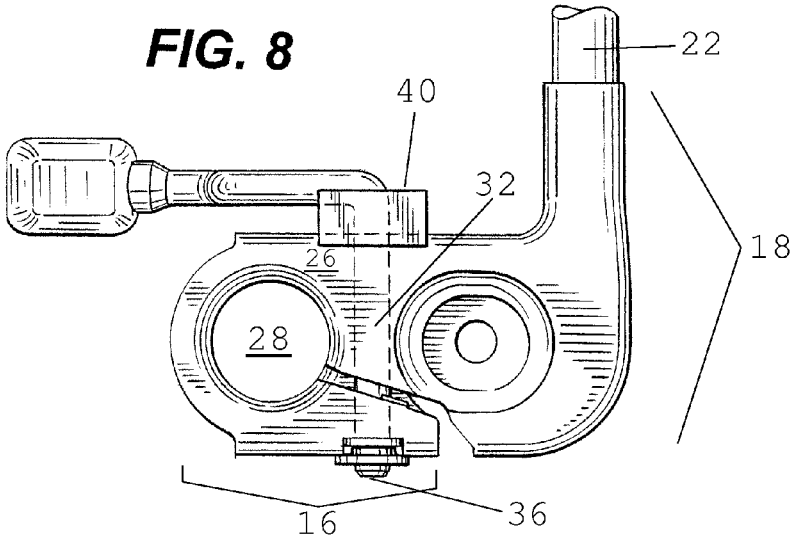
FIG. 8 is a view of the underside of the connector of FIG. 7.
Figure 9:
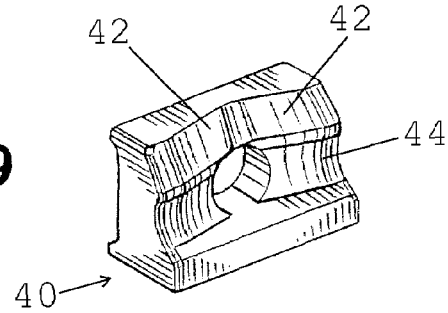
FIG. 9 is a perspective view of a locking block in accordance with the invention.
Figure 10:
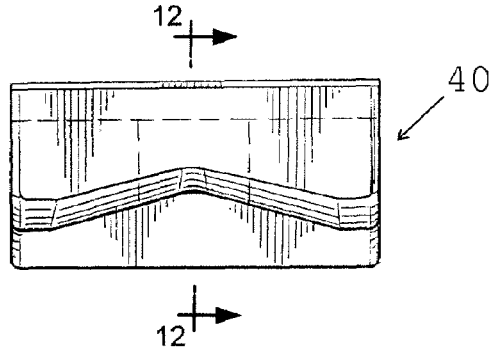
FIG. 10 is an overhead view of the locking block of FIG. 9.
Figure 11:
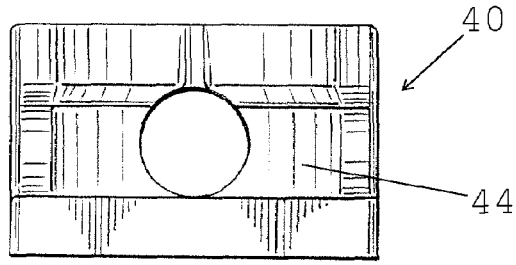
FIG. 11 is a side view of the locking block of FIG. 9.
Figure 12:
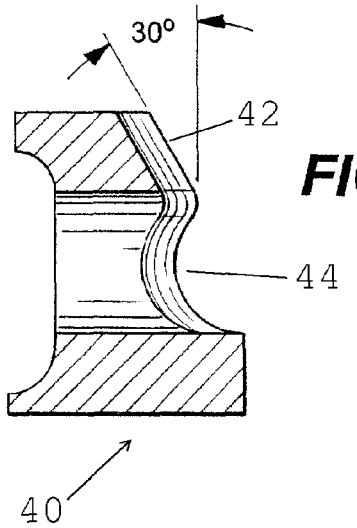
FIG. 12 is a sectional view of the locking block of FIG. 9, taken along lines 12-12 of FIG. 10.

As may best be seen in FIGS. 7 and 8, the invention is a battery terminal connector 10. As may be seen in FIGS. 2 and 3, this connector 10 is secured to a generally cube-shaped automotive battery 12. Such cube-shaped automotive batteries 12 are well-known in the art, and are commonly placed in the underhood or trunk areas of modern automobiles.

The battery terminal connector 10 is preferably made of copper or a copper alloy. One preferred copper alloy is a C-194 alloy. The connector 10 may be formed from a metal blank, such as a single piece of copper or sheet metal. Manufacturing the connector 10 by a stamping process from a single blank is both convenient and cost-efficient.

Figure 1:
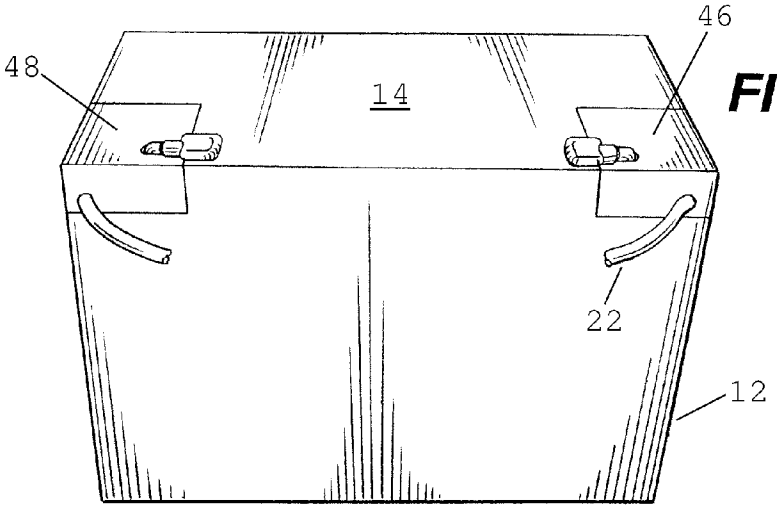
FIG. 1 is a perspective view of a portion of a pair of preferred terminal connectors in accordance with the present invention, shown extending from both a positive and negative battery post.

As may best be seen in FIG. 1, a pair of battery terminal connectors 10 may be positioned at both of the battery posts, i.e. at both the positive terminal post and the negative terminal post.

The automotive battery 12 has a flat, horizontally disposed top 14. The battery 12 generally provides the automobile's electrical system with power, typically twelve (12) volts, and 550 to 1000 cold cranking amps (CCA). A label is typically placed on the top 14 of the battery 12 to provide either the maintenance technician or the automobile's owner with information regarding the battery's manufacturer, specifications, and installation date.

The battery terminal connector 10 has a main body portion 16, and a ferrule portion 18. The body portion 16 is that portion of the connector 10 that secures that connector 10 to the battery post 20. The battery post 20 is of a generally frusto-conical shape. The ferrule portion 18 is that portion of the connector 10 that secures that connector 10 to the battery cable 22.

Figure 2:
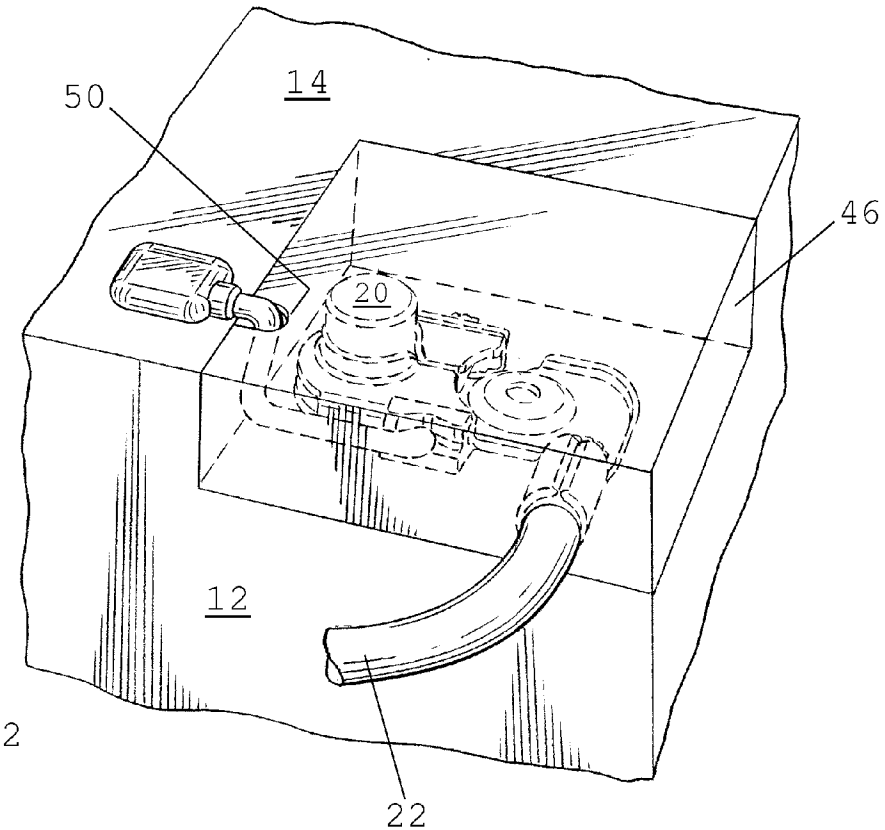
FIG. 2 is a perspective view of the top right corner of the battery of FIG. 1, showing in phantom lines a connector in accordance with the invention, with the lever in its first position, and positioned under an overcap.
Figure 3:
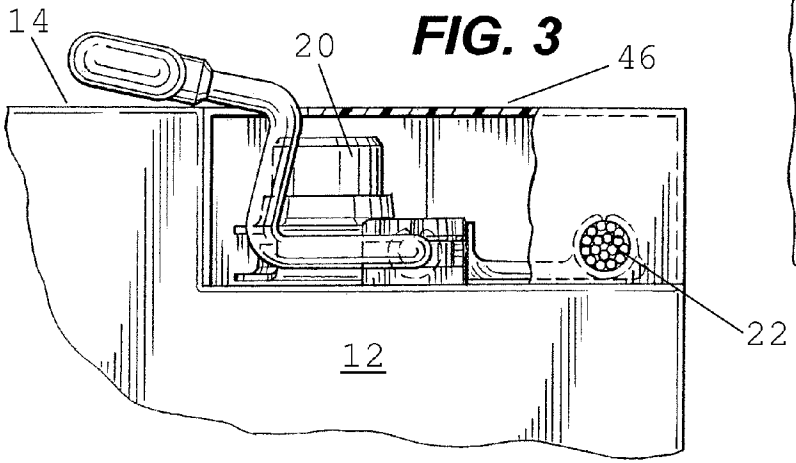
FIG. 3 is a side sectional view of the connector of FIG. 2.
Figure 4:
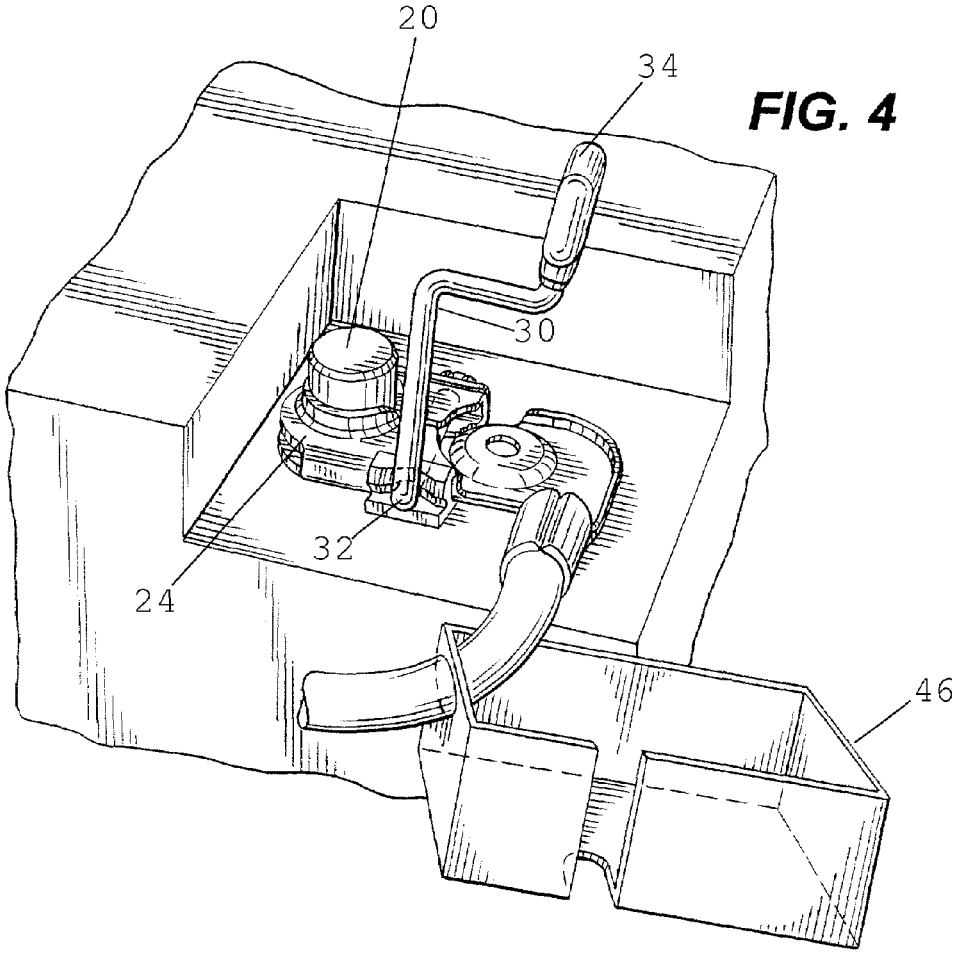
FIG. 4 is a perspective view of the connector of FIG. 2, but with the lever in the second position, resulting in removal of the overcap.

As may best be seen in FIGS. 7 and 8, the body portion 16 includes a top 24 and a bottom 26. When its overcaps 46 and 48 are removed, as shown in FIG. 4, and when the connector 10 is mounted to the battery 12, the top 24 of the body portion 16 of the connector 10 is visible to the technician. Because the bottom 26 of the body portion 16 abuts the battery when the connector 10 is installed, as shown in FIGS. 2 and 3, that bottom 26 is invisible to the technician.

The ferrule portion 18 is adapted for electrically connecting and securing the battery cable 22, through the ferrule portion 18, to the battery terminal post 20 of the vehicular battery 12. An insulation-free end of the battery cable 22 is placed into abutting contact with the initially open, malleable end portion of the ferrule portion 18. Then, the sides of the end portion are pushed towards each other so as to firmly grip, and in this way mechanically and electrically secure, the insulation-free end portion of that cable 22 to the ferrule portion 18. This securement of the cable 22 to the ferrule portion 18 of the connector 10 is shown in FIG. 7.

As may best be seen in FIGS. 7 and 8, the body portion 16 also includes an intermediate aperture 28. When the connector 10 is placed on the battery post 20 of the battery 12, this aperture 28 surrounds, grips, and engages the battery post 20.

The intermediate aperture 28 is of a size that varies, thereby accommodating placement of the connector 10 onto, and the removal of the connector 10 from, the battery post 20.

Figure 5:
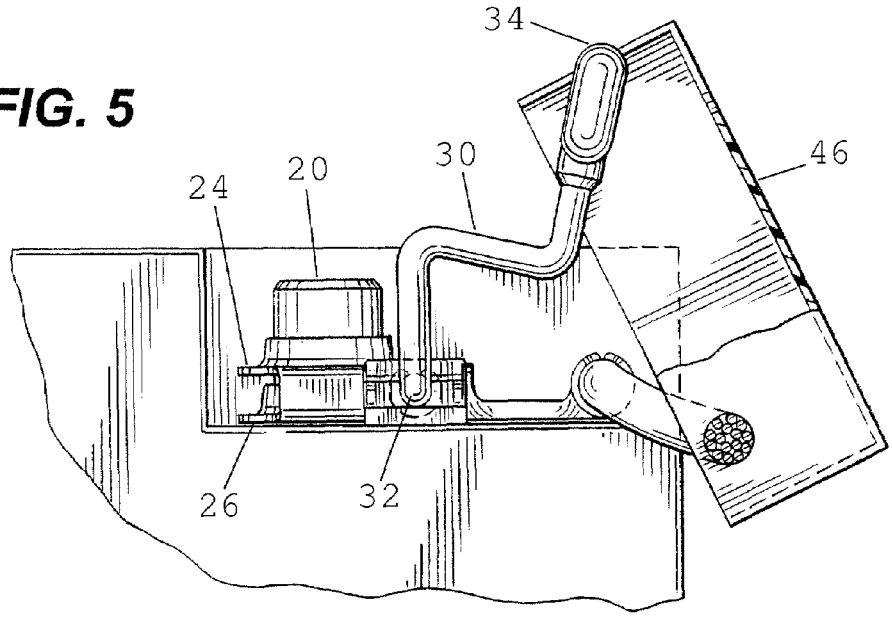
FIG. 5 is a side sectional view of the connector of FIG. 3, but with the lever in its second position, resulting in removal of the overcap.
Figure 6:
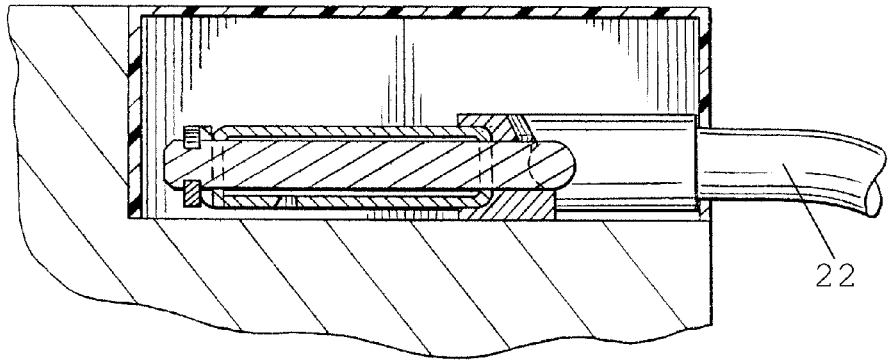
FIG. 6 is a sectional view of the connector in accordance with the invention, taken along lines 6-6 of FIG. 7.

In order to increase and decrease the size of the intermediate aperture 28, the battery terminal connector 10 has a lever 30, with two opposite ends, a first end 32 and a second end 34. This lever 30 is best shown in FIGS. 4 and 5. The first end 32 is of an elongated nature, and as may best be seen in FIG. 8, extends through the body portion 16 of the connector 10. In this particular embodiment, the first end 32 is connected to the terminal connector 10 along the width of the body portion 16, and is pivotally secured to the connector 10 at a pivot point 36.

In this embodiment, the second end 34 of the lever 30 has an insulating covering, in this embodiment a flat, plastic tab 38. This tab 38 facilitates the gripping of the lever 30 by the owner or technician, so that the owner or technician can more easily secure or release the connector 10 from the battery terminal post 20. The main portion of the lever 30 in this embodiment has a circular cross-section, with a diameter of approximately 0.187 inch. The lever 30 is typically made of a metal. In this embodiment, the metal is a 1010 C.R. steel, with a zinc phosphate coating.

Because the lever 30 is electrically conductive, the tab 38 should be made of a non-conductive material, to prevent the user from the potential dangers of electrical shock. The tab 38 may be made of a relatively hard plastic. In this embodiment, this hard plastic is preferably a glass-filled polypropylene. It is over-molded onto the end of the lever 30.

As may best be seen in FIGS. 1-5, both the second end 34 and the tab 38 of the lever 30 are positioned above the flat, horizontally disposed top 14 of the battery 12. In this way, the second end 34 and the tab 38 are easily accessible, so as to permit a user to actuate that lever 30.

The lever 30 is shown in its first position in FIGS. 1-3. In contrast, the lever 30 is shown in its second position in FIGS. 4-5.

When that lever 30 is moved from its first position of FIGS. 1-3 to its second position of FIGS. 4-5, the lever 30 releases the grip of the battery terminal connector 10 upon the battery post 20.

In contrast, when the lever 30 is moved from its second position of FIGS. 4-5 to its first position of FIGS. 1-3, the lever 30 facilitates the tight gripping of the battery terminal connector 10 onto the battery post 20.

As may best be seen in FIGS. 7-12, the connector 10 further includes a locking block 40. This locking block 40 has generally wedge-shaped ramping surfaces, in this case, a pair of ramping surfaces 42. This locking block 40 facilitates the fixed retention of the lever when that lever is in its first position. The locking block 40 provides resistance against the inadvertent movement of the lever 30 as a result of the shaking, jarring, and vibration that inevitably occurs during the normal operation of the motor vehicle in which the battery 12 is installed.

The resistance of the locking block 40 also tends to frictionally impede the movement of the lever 30, when the user attempts to move that lever 30 from its first position to its second position. This frictional impedence prevents the inadvertent release of the lever 30 when the user is servicing his car.

The resistance of the locking block 40 also includes a detent feature that provides the user with a "snap"-type sensation or feel, upon movement of the lever 30 along and through the ramping surfaces 42.

When the lever is snapped into its normal, first, lowered position of FIGS. 1-3, the lever 30 is retained within a slot 44.

In this invention, a portion of the lever 30 engages overcaps 46 and 48 on the automotive battery 12. These overcaps 46 and 48 are placed over the positive and negative terminals of the battery 12, respectively, and are held in place by a friction fit with the battery 12.

Particularly, when the lever 30 is in its first position, as shown in FIGS. 1-3, it extends through an opening or slot 50 in the overcap 46.

The lever engages a solid portion of the overcap 46 that borders the slot 50. This engagement facilitates the removal of the overcap 46.

This may be seen by a comparison of FIGS. 1-3 with FIGS. 4-5. When the user moves the lever 30 from the first position of FIGS. 1-3 to the second position of FIGS. 4-5, the lever 30 forces the overcap 46 away from the battery 12. The removal of the overcap 46 by the lever 30, when that lever 30 is moved into this second position, may best be seen in FIGS. 4-5.

At the same time, movement of the lever 30 from its first position of FIGS. 1-3 to its second position of FIGS. 4-5 releases the grip of the battery terminal connector 10 upon the battery post 20.

In a preferred embodiment, the lever 30 has a generally Z-shaped profile. This Z-shaped profile can best be seen in FIGS. 3-5. As noted above, this Z-shaped lever 30 facilitates the opening or closing of this aperture 28.

As also noted above, the size of the aperture 28 varies. Particularly, its size varies from (a) at a minimum, a size wherein the inner periphery of the aperture 28 tightly engages the exterior of the battery post 20, to permit normal operation of the battery 12 in the vehicular electrical system; to (b) at a maximum, a size wherein the periphery of the aperture 28 is spaced apart from the exterior of the battery post 20, so as to permit removal of the battery terminal connector 10 from the battery 12. Removal of the connector 10 from the battery 12 permits either (a) the removal of the battery 12 from the vehicle, or (b) the servicing, replacement, or cleaning of the battery terminal connector 10 or the battery terminal post 20.

While specific embodiments have been illustrated and described, numerous modifications come to mind without significantly departing from the spirit of the invention, and the scope of protection is only limited by the scope of the accompanying Claims.

What is claimed is:

1. A battery terminal connector for a generally cube-shaped automotive battery, said battery having a flat, horizontally disposed top, wherein said battery terminal connector has a body portion; the body portion having a top; a bottom; and an intermediate aperture for engaging a battery post; the intermediate aperture having a size that is variable to accommodate placement of the connector onto, and the removal of the connector from, the battery post; and said battery terminal connector further having a lever with two opposite ends, the first end being connected to the terminal connector, and the second end being positioned above the flat horizontally disposed top of the battery, whereby the second end is easily accessible so as to permit a user to actuate that lever, and move that lever from a first position to a second position, and wherein a portion of the lever engages overcaps on the automotive battery, so as to facilitate removal of said overcaps, upon movement of the lever from its first position to its second position.

2. The battery terminal connector of claim 1, wherein the connection of the first end of the lever to the battery terminal connector is a pivotal connection.

3. The battery terminal connector of claim 1, wherein the second end of the lever includes an insulating covering.

4. The battery terminal connector of claim 1, further comprising a locking block with generally wedge-shaped ramping surfaces, the locking block facilitating the fixed retention of the lever when that lever is in its first position, and providing resistance to the movement of the lever when that lever is being moved from its first position to the second position, and from its second position to its first position.

5. The battery terminal connector of claim 1, wherein movement of the lever from its first position to its second position releases the grip of the battery terminal connector upon the battery post.

6. The battery terminal connector of claim 1, wherein movement of the lever from its second position to its first position facilitates a grip of the battery terminal connector upon the battery post.

7. The battery terminal connector of claim 1, wherein the lever has a generally z-shaped profile.

* * * * *